US007918534B2

(12) United States Patent
Inoue et al.

(10) Patent No.: US 7,918,534 B2
(45) Date of Patent: Apr. 5, 2011

(54) DROPLET EJECTION HEAD HAVING A LIQUID EJECTION ENERGY DRIVING DEVICE, METHOD OF PRODUCING THE SAME AND DROPLET EJECTION APPARATUS

(75) Inventors: Hiroshi Inoue, Kanagawa (JP); Masaki Kataoka, Kanagawa (JP); Hiroki Murakami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 915 days.

(21) Appl. No.: 11/580,677

(22) Filed: Oct. 13, 2006

(65) Prior Publication Data

US 2007/0236524 A1 Oct. 11, 2007

(30) Foreign Application Priority Data

Apr. 10, 2006 (JP) ..... 2006-107832

(51) Int. Cl.
*B41J 2/135* (2006.01)
*B41J 2/16* (2006.01)

(52) U.S. Cl. ..... 347/45; 347/47

(58) Field of Classification Search ..... 347/45, 347/47, 15, 63; 427/249.7; 216/27
See application file for complete search history.

(56) References Cited

U.S. PATENT DOCUMENTS

| | | | | |
|---|---|---|---|---|
| 5,017,946 | A * | 5/1991 | Masuda et al. | 347/45 |
| 5,073,785 | A * | 12/1991 | Jansen et al. | 347/45 |
| 6,062,679 | A * | 5/2000 | Meyer et al. | 347/63 |
| 6,638,570 | B2 * | 10/2003 | Veerasamy | 427/249.7 |
| 2004/0124173 | A1 * | 7/2004 | Hess et al. | 216/27 |

FOREIGN PATENT DOCUMENTS

| | | |
|---|---|---|
| JP | 2983679 | 11/1999 |
| JP | 2004-284121 | 10/2004 |
| JP | 2004284121 | * 10/2004 |
| JP | 2006-010421 | 1/2006 |
| KR | 101998008578 | 12/1998 |
| KR | 102003003544 | 5/2003 |

* cited by examiner

*Primary Examiner* — Stephen D Meier
*Assistant Examiner* — Carlos A Martinez, Jr.
(74) *Attorney, Agent, or Firm* — Fildes & Outland, P.C.

(57) ABSTRACT

The present invention provides a droplet ejection head having a liquid ejection energy driving device to eject a liquid from a nozzle, the droplet ejection head including: a nozzle plate provided with a nozzle to eject liquid droplets; a tetrahedral amorphous carbon film provided on the nozzle plate; and a water-repellent film provided on the tetrahedral amorphous carbon film.

19 Claims, 6 Drawing Sheets

DROPLET EJECTION HEAD HAVING A LIQUID EJECTION ENERGY DRIVING DEVICE, METHOD OF PRODUCING THE SAME AND DROPLET EJECTION APPARATUS

BACKGROUND

1. Technical Field

The invention relates to a droplet ejection head that performs recording of images by ejecting droplets, for example, by an ink jet recording method, as well as to a method of manufacturing the droplet ejection head, and a droplet ejection apparatus provided with the droplet ejection head.

2. Related Art

Conventionally, ink jet recording apparatuses are known as droplet ejection apparatuses that perform printing on a recording medium such as a paper sheet by ejecting droplets from plural nozzles. These ink jet recording apparatuses are widely commercially available because of having the various advantages such as being small, inexpensive, and quiet. In particular, recording apparatuses of piezoelectric ink jet type that eject ink droplets by changing the pressure within a pressure chamber with the use of a piezoelectric element, or recording apparatuses of thermal ink jet type that eject ink droplets by expanding the ink with the use of the action of thermal energy, have numerous advantages such as providing high-speed printing and high resolution.

In such ink jet type recording apparatuses, in the ink jet recording head, problems are caused, such as adhesion of ink droplets to the periphery of the nozzle when the ink droplets are ejected from the nozzle or leakage of ink due to the overshoot phenomenon in which the ink wells out from the nozzle. Therefore, inclination of the direction of ink ejection or fluctuations in the droplet diameter of the ink or speed may occur, and thereby the printing property of the ink jet recording head may be significantly degraded. In view of this, the surface of the nozzle is coated with a water-repellent film so as to prevent ink droplets from adhering to the periphery of the nozzle.

The thickness of the above-described water-repellent film is made thin from the point of view of nozzle-forming properties or ejection stability. On the other hand, reduced thickness of the water-repellent film causes problems such as insufficient scratch resistance. Similar problems lie not only in ink jet recording heads but also in droplet ejecting heads in general.

SUMMARY

According to an aspect of the invention, there is provided a droplet ejection head having a liquid ejection energy driving device to eject a liquid from a nozzle, the droplet ejection head comprising:

a nozzle plate provided with the nozzle to eject liquid droplets;

a tetrahedral amorphous carbon film provided on the nozzle plate; and a water-repellent film provided on the tetrahedral amorphous carbon film.

BRIEF DESCRIPTION OF THE DRAWINGS

Exemplary embodiments of the present invention will be described based on the following figures, wherein.

DETAILED DESCRIPTION

In view of the above circumstances, the invention provides a droplet ejection head provided with a water-repellent film on the surface of a nozzle and a method of producing thereof, the droplet ejection head being superior in scratch resistance as well as nozzle-forming properties and ejection stability. The invention also provides a droplet ejection apparatus provided with the droplet ejection head.

The droplet ejection head of the invention is a droplet ejection head provided with a liquid ejection energy driving device to eject a liquid from a nozzle, the droplet ejection head comprising:

a nozzle plate provided with the nozzle to eject liquid droplets;

a tetrahedral amorphous carbon film provided on the nozzle plate; and a water-repellent film provided on the tetrahedral amorphous carbon film.

The method of producing the droplet ejection head of the invention is a method of producing a droplet ejection head provided with a liquid ejection energy driving device to eject a liquid from a nozzle, the method comprising:

forming a tetrahedral amorphous carbon film on a nozzle plate before formation of a nozzle to eject liquid droplets;

forming a water-repellent film on the tetrahedral amorphous carbon film; and forming the nozzle on the nozzle plate.

The droplet ejection apparatus of the invention is provided with the above-mentioned droplet ejection head of the invention.

Hereafter, the invention will be described with reference to the attached drawings. Here, members having substantially identical function are denoted with the same symbols all throughout the drawings, and duplicated description thereof may be omitted in some cases.

Figure 1:
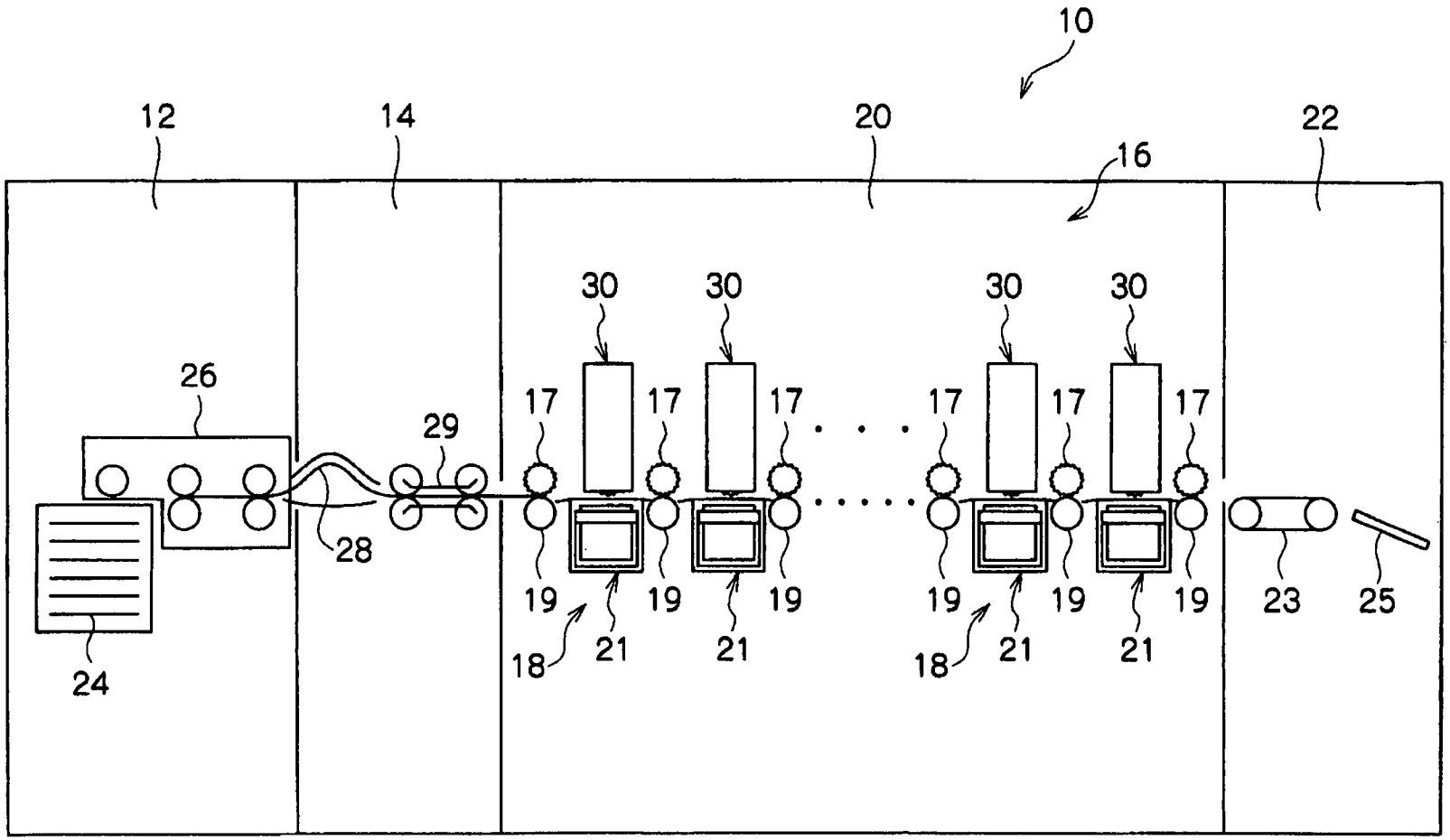
FIG. 1 is a schematic constructional view showing an ink jet recording apparatus according to an embodiment of the invention.
Figure 2:
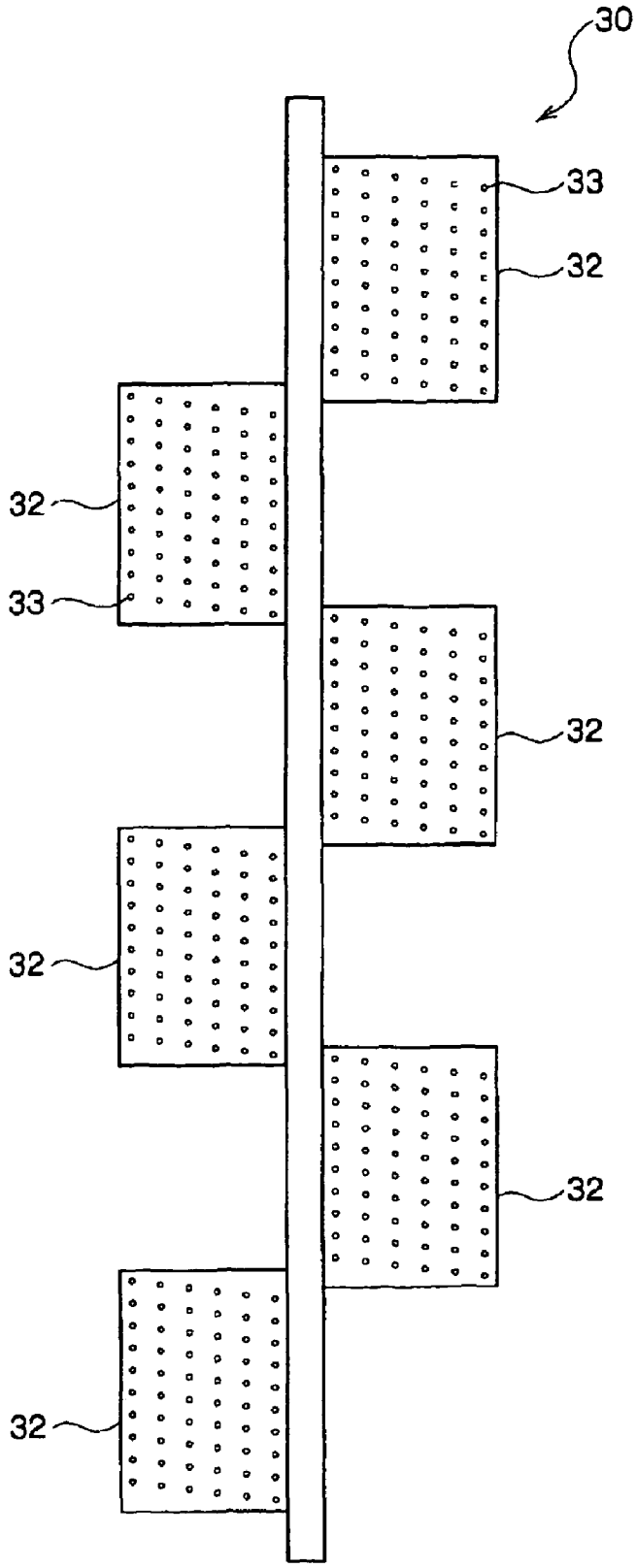
FIG. 2 is a schematic view showing a recording head arrangement of an ink jet recording unit according to an embodiment of the invention.
Figure 3:
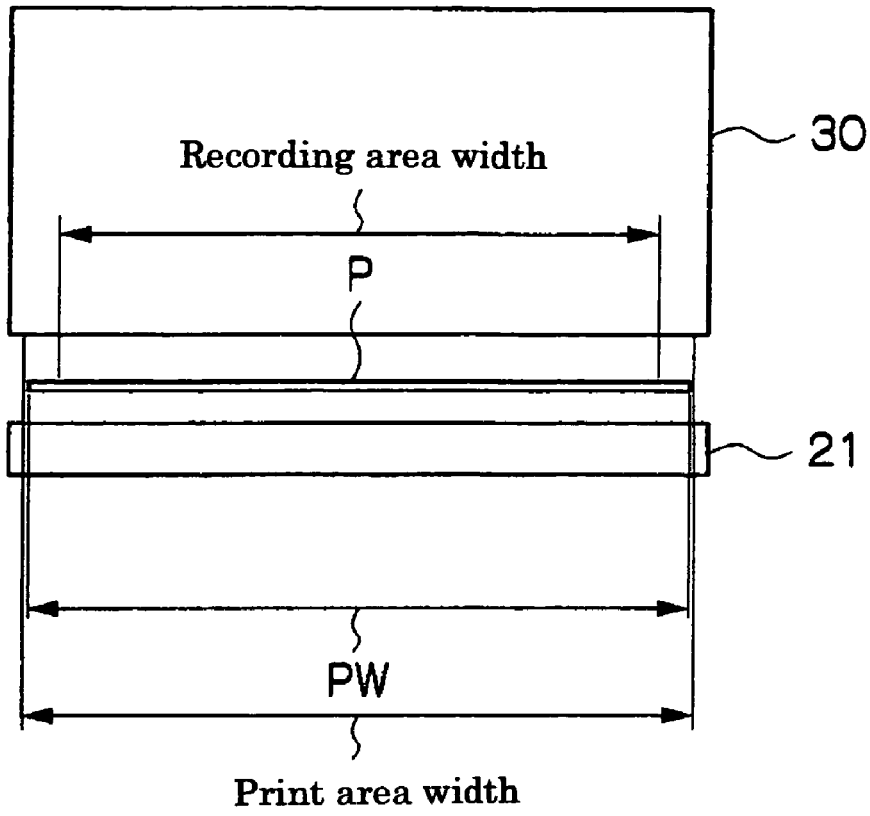
FIG. 3 is a view showing a print area with an ink jet recording unit of an embodiment.

FIG. 1 is a schematic constructional view showing an ink jet recording apparatus according to an embodiment of the invention. FIG. 2 is a schematic view showing a recording head arrangement of an ink jet recording unit according to the embodiment of the invention. FIG. 3 is a view showing a print area with the ink jet recording unit of the embodiment.

Referring to FIG. 1, an ink jet recording apparatus 10 (droplet ejection apparatus) according to the embodiment is generally composed of a paper sheet supplying section 12 for feeding paper sheets; a registration adjustment section 14 for controlling the position of the paper sheets; a recording head section 16 for forming an image on a recording medium P by ejecting ink droplets (liquid droplets); a recording section 20 equipped with a maintenance section 18 for maintenance of the recording head 16; a maintenance section 18 for performing maintenance of the recording head 16; and a discharging section 22 for discharging the paper sheets carrying the image formed in the recording section 20.

The paper sheet supplying section 12 is composed of a stocker 24 in which the paper sheets are stacked and stocked, and a feeding apparatus 26 for feeding the paper sheets one by one from the stocker 24 to the registration adjustment section 14.

The registration adjustment section 14 is equipped with a loop forming section 28 and a guide member 29 for controlling the position of the paper sheets. By passing through this part, the skew of the paper sheets is corrected utilizing the elasticity thereof and the timing of feeding is controlled, then the paper sheets proceed into the recording section 20.

In the discharging section 22, the paper sheets carrying the image formed in the recording section 20 are stored into a tray 25 via a paper discharging belt 23.

Between the recording head 16 and the maintenance section 18, a paper sheet conveyer is constructed for conveying the recording medium P. The recording medium P is pinched by a star wheel 17 and a transportation roll 19 to be continuously (without stopping) conveyed. Then, ink droplets are ejected from the recording head section 16 to the paper sheet to form an image thereon.

The maintenance section 18, being composed of a maintenance apparatus 21 disposed in opposition to the ink jet recording unit 30 (recording head 32), can perform processes such as capping, wiping, and also dummy jetting and vacuum, for the ink jet recording unit 30 (recording head 32).

Referring to FIG. 2, each of the ink jet recording units 30 is equipped with plural ink jet recording heads 32 arranged in a direction perpendicular to the paper sheet conveying direction. Plural nozzles 33 are formed in a matrix form on the ink jet recording head 32. By ejecting ink droplets from the nozzles 33 onto the recording medium P being conveyed continuously in the paper sheet conveyer, an image is formed on the recording medium P. Here, at least four of the ink jet recording unit 30 are provided, for example, in correspondence with each color of yellow, magenta, cyan, and black for recording a so-called full-color image.

Referring to FIG. 3, the print area width of the nozzles 33 of each ink jet recording unit 30 is set to be longer than the maximum paper sheet width PW of the recording medium P on which an image is assumed to be recorded by this ink jet recording apparatus 10, whereby an image can be recorded across the full width of the recording medium P without moving the ink jet recording unit 30 in a direction of paper sheet width (i.e. a so-called full width array (FWA)). Here, the print area is based on the maximum of the recording area excluding the margins at both ends, where printing is not carried out, but is generally set to be larger than the maximum paper sheet width PW, where printing is to be carried out. This is because of a possibility for the paper sheet of being conveyed in a tilted (skewed) manner at a certain angle to the conveying direction, and of a high demand for printing without the margins.

Figure 4:
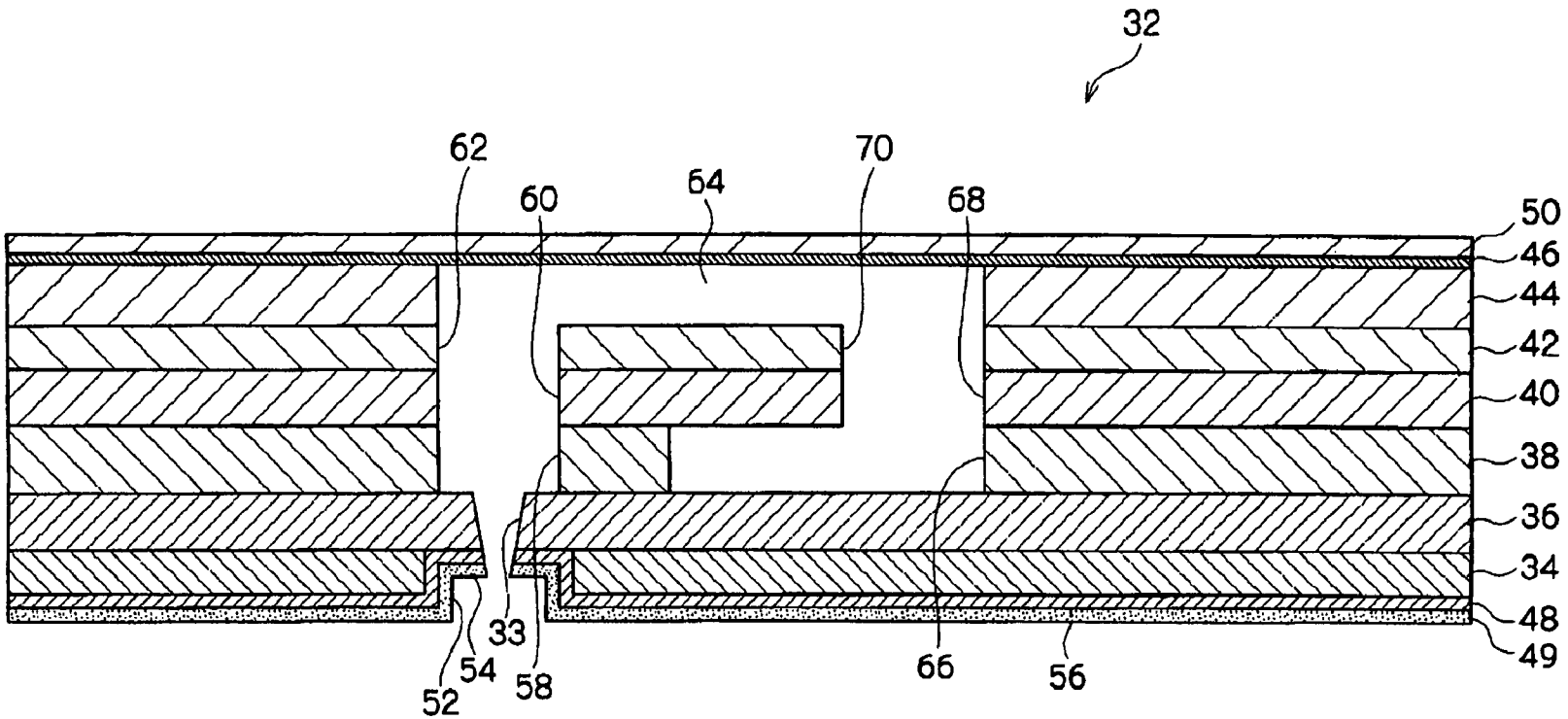
FIG. 4 is a schematic cross-sectional view showing a construction of an ink jet recording head according to an embodiment of the invention.

Next, in the ink jet recording apparatus 10 having a construction as described above, the ink jet recording head 32 will be described in detail. FIG. 4 is a schematic cross-sectional view showing a construction of the ink jet recording head according to the embodiment of the invention. FIGS. 5A to 5F are process views showing a process of producing the ink jet recording head according to the embodiment of the invention.

Referring to FIG. 4, the ink jet recording head 32 is produced by laminating a protection plate 34, a nozzle plate 36, a pool plate 38, communication hole plates 40 and 42, a pressure chamber plate 44, and a vibration plate 46 in position and bonding them by thermal fusion or with an adhesive. Then, a tetrahedral amorphous carbon (hereinafter, referred to as ta-C) film 48 and a water-repellent film 49 are sequentially formed on a surface of the protection plate 34 on the nozzle plate 36.

A nozzle 33 for ejecting ink is formed in the nozzle plate 36. A step hole 52 is formed around the nozzle 33, in the protection plate 34 joined to the nozzle plate 36. By means of this step hole 52, the nozzle surface 54 around the nozzle 33 is retreated in a concave manner from the plate surface 56 of the protection plate 34 (the surface of the protection plate 34 onto which the ta-C film 48 and the water-repellent film 49 are applied). In this way, the recording medium P moving up at the time of printing can be prevented from being brought into contact with the plate surface 56.

The water-repellent film 49 is for preventing ink from adhering to the periphery of the nozzle 33. Owing to this water-repellent film 49, ink droplets ejected from the nozzle 33 can be constantly ejected vertically to the plate surface 56.

However, when the thickness of the water-repellent film 49 is increased, nozzle-forming properties and ejection stability are degraded. On the other hand, when the thickness of the water-repellent film 49 is reduced, scratch resistance is degraded, even though the nozzle-forming properties and ejection stability are improved.

In view of this, a ta-C film 48 is provided under the water-repellent film 49 to reduce the thickness of the water-repellent film 49, which serves to improve nozzle-forming properties and ejection stability, and at the same time, improves scratch resistance as well.

In addition, referring to FIG. 4, a communication hole 58, which is in communication with the nozzle 33, is formed in the pool plate 38. Also, communication holes 60 and 62 are formed in the communication hole plates 40 and 42, respectively. The nozzle 33, the communication hole 58, and the communication holes 60 and 62 are in communication with each other where the nozzle plate 36 and the communication hole plates 40 and 42 are laminated, and are connected to a pressure chamber 64 formed in the pressure chamber plate 44.

On the other hand, an ink pool 66 is formed in the pool plate 38, where the ink supplied from an ink supplying hole (not shown) is stored. Also, supplying holes 68 and 70 are formed in the communication hole plates 40 and 42, respectively, so as to be in communication with the ink pool 66. The ink pool 66, the supplying holes 68 and 70, and the pressure chamber 64 are in communication with each other where the pool plate 38, the communication hole plates 40 and 42, and the pressure chamber plate 44 are laminated. On the vibration plate 46 (on the surface opposite to the surface to be joined to the pressure chamber plate 44), a single-plate type piezoelectric element 50 serving as a pressure generator is mounted above the pressure chamber 64, and a driving voltage is applied thereto from a flexible wiring substrate (not shown).

The droplet ejection energy device to eject a liquid from the nozzle is not limited to the above-mentioned piezoelectric element 50 and, for example, a thermal system applying a heating element (electrothermal converting element) may also be utilized.

In the ink jet recording head 32 as described above, a flow passageway for ink is formed, which is continuous throughout the ink pool 66 to the supplying holes 68 and 70, the pressure chamber 64, the communication holes 60 and 62, the communication hole 58, and the nozzle 33. The ink supplied from an ink supplying hole (not shown) and stored in the ink pool 66 is introduced to fill the pressure chamber 64 via the supplying holes 68 and 70. When a driving voltage is applied to the piezoelectric element 50, the vibration plate 46 is deflected to deform, along with the piezoelectric element 50, expanding or compressing the pressure chamber 64. This causes a volume change in the pressure chamber 64, thereby generating a pressure wave in the pressure chamber 64. By the action of this pressure wave, the ink is moved, whereby the ink droplets are ejected from the nozzle 33.

Next, a method of producing the ink jet recording head 32 will be described.

Figure 5A:
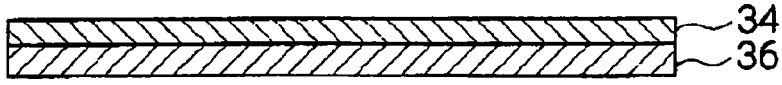
FIGS. 5A to 5F are process views showing a process of producing an ink jet recording head according to an embodiment of the invention.

First, referring to FIG. 5A, a plate-shaped nozzle plate 36 before formation of a nozzle 33 therein, and a plate-shaped protection plate 34 before formation of a step hole 52 therein, are joined together by thermal fusion. By joining the two of the nozzle plate 36 and the protection plate 34 by thermal fusion without an adhesive, the two can be joined efficiently since there is no need of adjusting the position of them. For the nozzle plate 36, a silicon water, an SUS plate, a synthetic resin plate or the like can be used, preferably a synthetic resin which is excellent in mechanical strength, chemical resistance, and capability of being formed into a thin film. In the embodiment, a polyimide is used for the nozzle plate 36. Using a polyimide have the benefit of more easily processing a nozzle than a case where a conventional SUS is used, and restraining cross-talking by means of a damper effect when ejection energy is applied to the ink. For the protection plate 34, a metal plate, a resin film, a liquid crystal film, a resin plate or the like can be used. In the embodiment, an SUS is used for the protection plate 34.

Figure 5B:
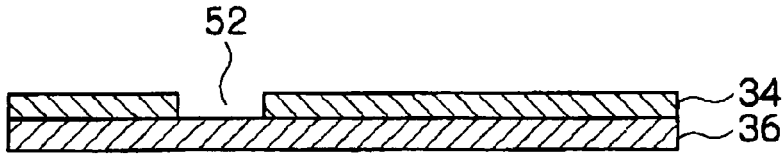

Subsequently, referring to FIG. 5B, a step hole 52 is formed in the plate-shaped protection plate 34. In forming the step hole 52, first, a resist is formed and, after patterning on the resist through a mask, unnecessary portion of the resist is removed to form a hole part corresponding to the position for the step hole 52. Then, a pattern for the step hole 52 is formed on the protection plate 34 by wet etching, and the resist is removed. The depth of this step hole 52 is set in the range of, for example, from about 5 μm to 20 μm.

Figure 5C:
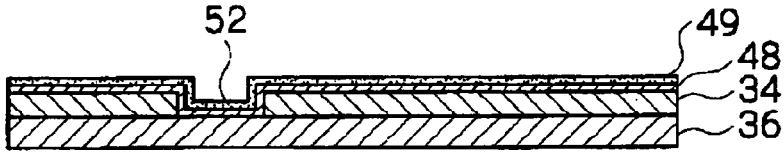

Then, referring to FIG. 5C, a ta-C film 48 is formed on the surface of the protection plate 34, i.e., on the ejection-side surface of the ink jet recording head 32 (See FIG. 1), and thereafter, a water-repellent film 49 is formed.

The ta-C (Tetrahedral Amorphous Carbon) film 48 is made of a carbonaceous substance with a high degree of hardness and a high degree of Young's Modulus, the hardness being higher than that of a conventional Diamond-like Carbon, thus superior in preventing scratches caused by scraping or scratching.

The method of forming the ta-C film 48 is not particularly limited, but a plasma-enhanced chemical vapor deposition method or a cathodic arc method can be applied. The cathodic arc method is a method of forming a film by extracting C+ from a carbon (graphite) by means of arc discharge. The film formed by this cathodic arc method has properties described in, for example, International Conference on Micromechatronics for Information and Precision Equipment (Tokyo, Jul., 20-23, 1997, pp. 357-362), and has benefits of having stronger sp3 bond, higher degree of hardness and lower friction coefficient, as compared to DLC films formed by other methods such as a reactive sputtering method or an ECR-CVD (Electron Cycltoron Resonance-Chemical Vapor Deposition) method.

Typical characteristic values of the ta-C film 48 are shown in Table 1. For comparison, typical characteristic values of a natural diamond layer, a Diamond-like Carbon (DLC) layer, and a flexible Diamond-like Carbon layer are also shown in Table 1.

TABLE 1

| | Natural Diamond | DLC | FDLC | ta-C |
|---|---|---|---|---|
| Film thickness | — | 1.5 | Middle | 1.0 or less |
| Filming temperature | — | 80° C. or more | Middle | 20° C. to 80° C. |
| Filming rate (nm/s) | — | 0.5 | Middle | 1.5 |
| Raw material | — | Hydrocarbon | Hydro-carbon | Solid carbon |
| Crystal structure | Diamond structure sp3 | Amorphous sp3 50% or less | Middle | Amorphous sp3 85% or more |
| Hardness (GPa) | 100 | 10 to 50 | Middle | 60 to 90 |
| Young's modulus (GPa) | 910 | 280 to 300 | Middle | 600 to 900 |
| Density (g/cm$^3$) | 3.5 | 1.7 to 2.2 | Middle | 3.0 to 3.2 |
| Friction coefficient | 0.1 | 0.14 | Middle | 0.1 |
| Refractive index | 2.4 | 2.4 | 2.4 | 2.4 |
| Electric resistance | 10e13 to 10e16 | 10e6 to 10e14 | 10e6 to 10e9 | 10e6 to 10e9 |
| Thermal conductivity (W/mk) | 2000 | 30 | Middle | 6 |

As shown in Table 1, the ta-C film 48 has a lower film-forming temperature as compared to the DLC and FDLC layers, thus suppressing retroflection of a nozzle plate due to film formation or detachment between a protection plate and the nozzle plate. Table 1 also shows that the density of the ta-C film is high, thus enhancing the adhesion to the adjacent film to make it hard for the ta-C film to detach from the adjacent film.

The thickness of the ta-C film 48 is preferably about 3 to 80 nm, more preferably about 10 to 50 nm, and further preferably about 20 to 40 nm. When the thickness is below the said range, defects in the film or degradation of scratch resistance may occur. On the other hand, when the thickness exceeds the said range, nozzle-forming properties or ejection stability may be lowered.

Figure 6:
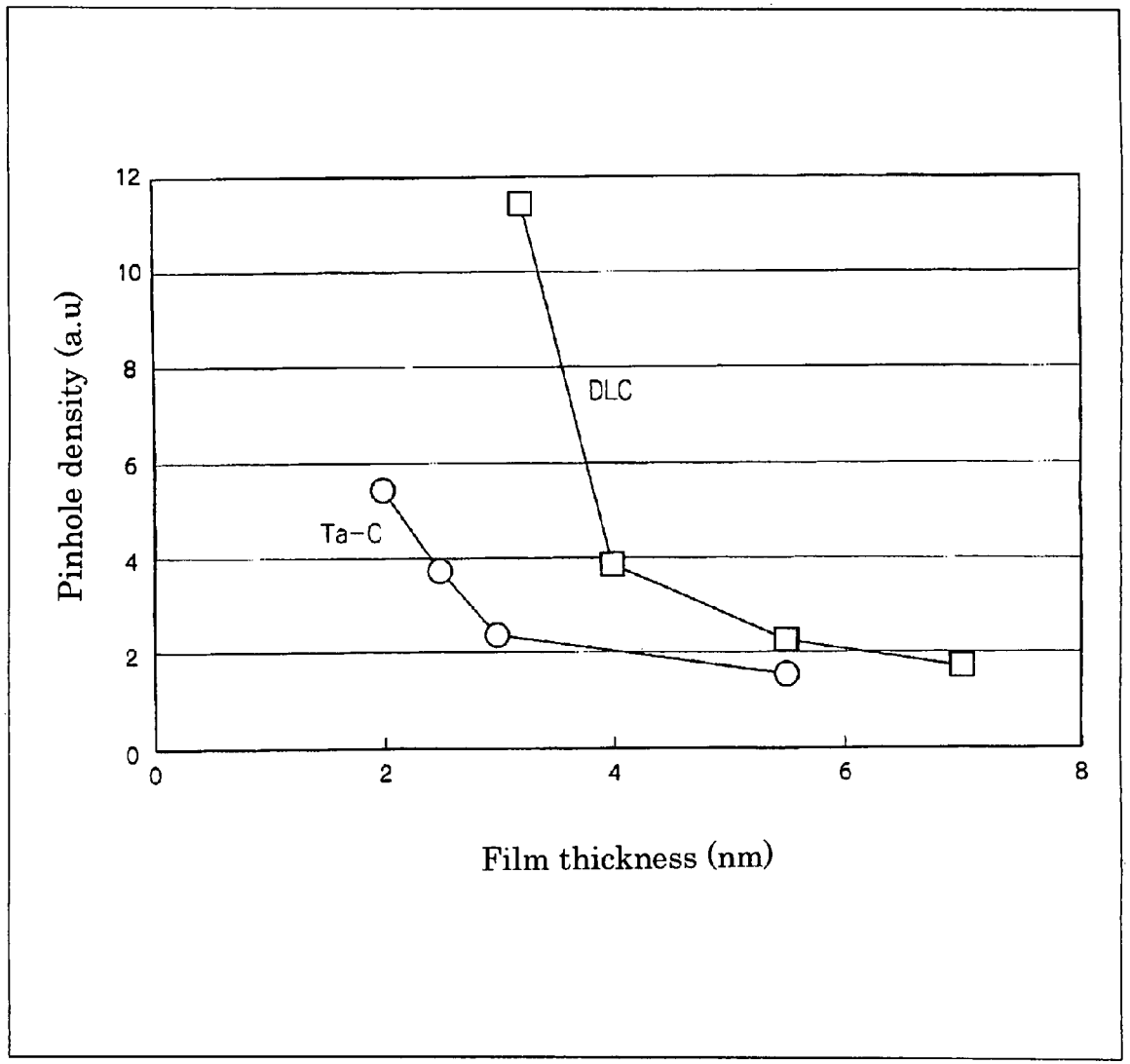
FIG. 6 is a graph showing the relationship of a film thickness of the ta-C film and a pinhole density.

FIG. 6 shows a relationship between the thickness of the ta-C film 48 and a pinhole density. For comparison, the same relationship according to a DLC film is also shown in FIG. 6. As shown, the ta-C film can be formed thinner and higher in hardness, as compared to the DLC film.

On the other hand, a water-repellent film 49 may be, for example, a fluorine-based water-repellent film, a silicon-based water-repellent film, a plasma-polymerized protection film, or a polytetrafluoroethylene (PTFE)-nickel eutectoid plating film. Among these, a fluorine-based water-repellent film having a high water repellency is preferable, and preferable examples of constituent material thereof include, for example, a fluorine-based resin such as a tetrafluoroethylene-hexafluoropropylene copolymer resin (FEP), a polytetrafluoroethylene resin (PTFE), a tetrafluoroethylene-perfluoroalkoxyethylene copolymer resin (PFA), a polyvinylidene fluoride resin, or a polyvinyl fluoride resin. In particular, a polytetrafluoroethylene resin (PTFE) and a tetrafluoroethylene-perfluoroalkoxyethylene copolymer resin (PFA) are preferable.

The fluorine-based water-repellent film can be formed in accordance with a plasma-enhanced chemical vapor growth method or deposition method. Further, the fluorine-based water-repellent film can be formed by forming a fluorine-based resin precursor by the above methods, then polymerizing the fluorine-based resin precursor by heating. The fluorine-based water-repellent film can also be formed by a spin coat method or a spray method, as a matter of course.

The thickness of the water-repellent film 49 is preferably about 1 to 30 nm, more preferably about 5 to 20 nm, and further preferably about 10 to 15 nm. When the thickness is below the said range, defects in the film or degradation of scratch resistance may occur. On the other hand, when the thickness exceeds the said range, nozzle-forming properties or ejection stability may be lowered.

Since the ta-C film 48 and the water-repellent film 49 can be formed in accordance with the above-described methods, the water-repellent film 48 and the water-repellent film 49 can be formed uniformly in thickness not only on the surface of the protection plate 34 on the nozzle plate 36, but also inside the step hole 52 (including the bottom part).

Figure 5D:
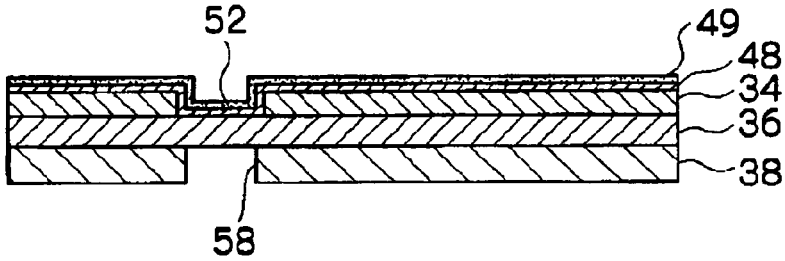

Subsequently, referring to FIG. 5D, the pool plate 38 is joined to the back surface of the nozzle plate 36 by thermal fusion. By performing the thermal fusion, an adhesive is not used for joining. In this thermal fusion, a thermal treatment at 300 to 360° C. is typically carried out. In the embodiment, the thermal fusion is performed by a thermal treatment at 330° C. Here, in the embodiment, the joining is described as being performed by thermal fusion, but the joining may be carried out using an adhesive. In the latter case, for example, a thermal treatment at 200° C. is carried out.

Figure 5E:
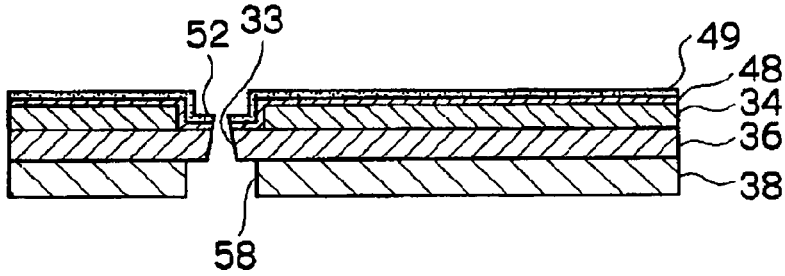

Subsequently, referring to FIG. 5E, a nozzle 33 is formed in the nozzle plate 36 by drilling with an excimer laser (not shown) from the backside of the pool plate 38 (the side where the water-repellent film 49 is formed). This nozzle 33 is formed to have an aperture diameter smaller than the hole diameter of the step hole 52. In the embodiment, the aperture diameter of the nozzle 33 is set at about 25 μm, and the aperture diameter of the step hole 52 is set at 100 μm to 400 μm. A plurality of such nozzles 33 and step holes 52 are formed in a predetermined pattern.

Here, in the embodiment, an excimer laser is used for forming nozzles, but other means such as a YAG triple harmonics wave, a YAG quadruple harmonics wave, etching, punching or the like can also be used. Here, in view of processability, the excimer laser is most suitably used.

Figure 5F:
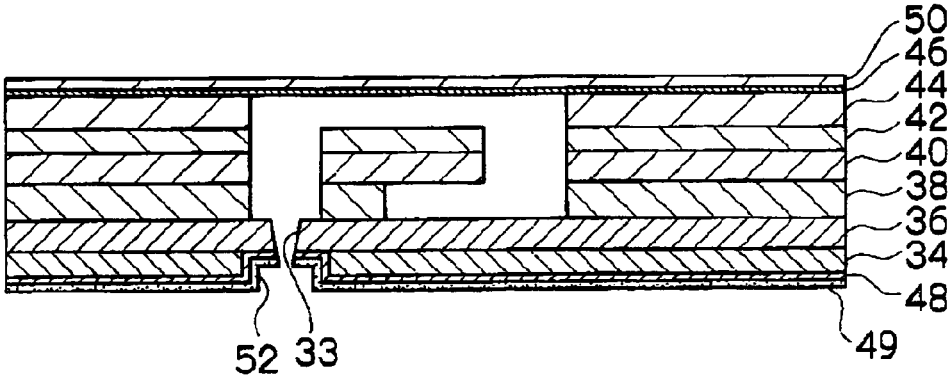

A first lamination plate is thus prepared. Then, as shown in FIG. 5F, a second lamination plate is prepared in a separate step by joining communication hole plates 40 and 42 and a pressure chamber plate 44 beforehand, and further joining a vibration plate 46 thereto so as to cover an opening in the pressure chamber plate 44. The first lamination plate and the second lamination plate are then joined together in the manner the communication plate 40 and the pool plate 38 of the two lamination plates face to each other.

In this manner, an ink jet recording head 32 is prepared.

As described above, in this embodiment, the ta-C film 48 which is a thin film with a high degree of hardness, and the water-repellent film 49 are sequentially formed on the nozzle plate 36, via the protection plate 34 in the ink jet recording head 32. However, at the periphery of the nozzle, the ta-C film 48 is directly formed on the nozzle plate, and the water-repellent film 49 thereon.

Here, in the embodiment, an example of FWA corresponding to paper width has been described. However, the ink jet recording head of the invention is not limited to this, and can also be applied to an apparatus of partial width array (PWA) having a main scanning mechanism and a sub scanning mechanism.

Also, in the embodiment, images (including characters) are recorded on a recording medium P. However, the droplet ejection head and the droplet ejection apparatus of the invention are not limited to this. Namely, the recording medium is not limited to paper, and the liquid to be ejected is not limited to ink, either. For example, the invention can be applied in general to droplet ejection heads and droplet ejection apparatuses for industrial uses such as preparation of a color filter for a display device by ejecting ink onto a polymer film or glass, and formation of bumps for mounting electrical parts by ejecting solder in a molten state onto a substrate.

EXAMPLES

Hereinafter, in the above-described embodiment, examples for evaluation having a ta-C film 48 and a water-repellent film 49 sequentially formed on a nozzle plate 36 are shown. Comparative examples are also shown for comparison with these examples.

Example 1

First, a ta-C film is formed at a thickness of 3 nm on the surface of an polyimide film (nozzle plate) with a FCVA (Filtered Cathodic Vacuum Arc) apparatus (manufactured by Shimazu Seisaku-sho Ltd.).

Next, a water-repellent film is formed on the ta-C film at a thickness of 10 nm, by forming a fluorine-based water-repellent film by a deposition method, then polymerizing the film by heating.

Thereafter, a nozzle having a diameter of 25 μm is formed by irradiating an excimer laser (wavelength: 248 nm) from the side opposite to the side on which the water-repellent film is formed.

In this way, a nozzle plate 36 is obtained.

Examples 2 to 5

In accordance with Table 2, nozzle plates are obtained in the same manner as Example 1, except that the thickness of a ta-C film and a water-repellent film are changed.

Comparative Example 1

First, a DLC film is formed at a thickness of 3 nm, on the surface of a polyimide film (nozzle plate) with an ECR-CVD apparatus.

Next, a water-repellent film is formed on the DLC film at a thickness of 10 nm, by forming a fluorine-based water-repellent film by a deposition method, then polymerizing the film by heating.

Thereafter, a nozzle having a diameter of 25 μm is formed by irradiating an excimer laser (wavelength: 248 nm) from the side opposite to the side on which the water-repellent film is formed.

In this way, a nozzle plate is obtained.

Comparative Example 2

First, a $SiO_2$ film is formed in the thickness of 100 nm on the surface of a polyimide film (nozzle plate) by a sputtering method.

Subsequently, a water-repellent film is formed on the $SiO_2$ film in the thickness of 20 nm by forming a fluorine-based water-repellent film by a deposition method, then polymerizing the film by heating.

Thereafter, a nozzle having a diameter of 25 μm by irradiating an excimer laser (wavelength: 248 nm) from the side opposite to the side on which the water-repellent film is formed.

In this way, a nozzle plate is obtained.

Evaluation

By using the obtained nozzle plates, recording heads are prepared in accordance with the above-described embodiments, then ejection stability and scratch resistance are evaluated. Additionally, nozzle-forming properties at the time of processing a nozzle are also evaluated. The results are shown in Table 2.

Ejection stability is evaluated as follows. The amount of droplets during continuous ejection are measured, and substantially no fluctuation in the amount of droplets is evaluated as A, a large degree of fluctuation in the amount of 20 droplets as C, and in between A and C as B.

Scratch Resistance

Scratch resistance is evaluated as follows. Obtained samples are set in a scratch testing machine manufactured by Fuji Xerox Co. Ltd., and when the surface of the water-repellent film is scraped with a rubber blade for 5000 times, substantially no scratch is evaluated as A, a number of scratches as C, and in between A and C as B.

Nozzle-Forming Properties

Nozzle-forming properties are evaluated as follows. When a nozzle is processed with an excimer laser, good processability and nozzle hole uniformly formed is evaluated as A, poor processability and nozzle hole not uniformly formed as C, and in between A and C as B.

TABLE 2

| | Nozzle plate | | Evaluation | | |
|---|---|---|---|---|---|
| | Undercoat film Material/ Thickness | Water repellent film Thickness | Ejection stability | Scratch resistance | Nozzle-forming properties |
| Example 1 | ta-C/3 nm | 10 nm | A | A | A |
| Example 2 | ta-C/20 nm | 20 nm | A | A | A |
| Example 3 | ta-C/80 nm | 10 nm | A | A | A |
| Example 4 | ta-C/1 nm | 10 nm | A | B | A |
| Example 5 | ta-C/110 nm | 10 nm | B | A | B |
| Comparative Example 1 | DLC/3 nm | 10 nm | A | C | A |
| Comparative Example 2 | SiO2/ 110 nm | 20 nm | C | A | C |

As shown in Table 2, ejection stability, scratch resistance and nozzle-forming properties of Examples are excellent all together, as compared to Comparative examples. Table 2 also shows that it is preferable that the ta-C film and the water-repellent film are formed in the predetermined film thicknesses.

All publications, patent applications, and technical standards mentioned in this specification are herein incorporated by reference to the same extent as if each individual publication, patent application, or technical standard was specifically and individually indicated to be incorporated by reference.

What is claimed is:

1. A droplet ejection head having a liquid ejection energy driving device to eject a liquid from a nozzle, the droplet ejection head comprising:

a nozzle plate provided with a nozzle to eject liquid droplets;

a tetrahedral amorphous carbon film provided on the nozzle plate, the tetrahedral amorphous carbon film having a thickness of about 3 to 80 nm; and a water-repellent film provided on the tetrahedral amorphous carbon film, the water-repellent film having a thickness of about 5 to 20 nm.

2. The droplet ejection head according to claim 1, wherein the tetrahedral amorphous carbon film is formed by a plasma-enhanced chemical vapor deposition method or a cathodic arc method.

3. The droplet ejection head according to claim 1, wherein the water-repellent film comprises a fluorine-based resin.

4. The droplet ejection head according to claim 3, wherein the water-repellent film comprising a fluorine-based resin is formed by a plasma-enhanced chemical vapor growth method or deposition method.

5. The droplet ejection head according to claim 3, wherein the water-repellent film comprising a fluorine-based resin is formed by forming a fluorine-based resin precursor by a plasma-enhanced chemical vapor growth method or deposition method, then polymerizing the fluorine-based resin precursor by heating.

6. The droplet ejection head according to claim 1, wherein the nozzle plate comprises a polyimide resin.

7. A droplet ejection apparatus having the droplet ejection head according to claim 1.

8. The droplet ejection head according to claim 1, wherein the tetrahedral amorphous carbon film has a thickness of about 20 to 40 nm.

9. The droplet ejection head according to claim 1, wherein the water-repellent film has a thickness of about 10 to 15 nm.

10. The droplet ejection head according to claim 1, wherein an area around the nozzle is retreated in a concave manner.

11. A method of producing a droplet ejection head having a liquid ejection energy driving device to eject a liquid from a nozzle, the method comprising:

forming a tetrahedral amorphous carbon film having a thickness of about 3 to 80 nm on a nozzle plate before formation on the nozzle plate of a nozzle to eject liquid droplets;

forming a water-repellent film having a thickness of about 5 to 20 nm on the tetrahedral amorphous carbon film; and forming the nozzle on the nozzle plate.

12. The method of producing the droplet ejection head according to claim 11, wherein the tetrahedral amorphous carbon film is formed by a plasma-enhanced chemical vapor deposition method or a cathodic arc method.

13. The method of producing the droplet ejection head according to claim 11, wherein the water-repellent film comprises a fluorine-based resin.

14. The method of producing the droplet ejection head according to claim 13, wherein the water-repellent film comprising a fluorine-based resin is formed by a plasma-enhanced chemical vapor growth method or deposition method.

15. The method of producing the droplet ejection head according to claim 13, wherein the water-repellent film comprising a fluorine-based resin is formed by forming a fluorine-based resin precursor by a plasma-enhanced chemical vapor growth method or deposition method, then polymerizing the fluorine-based resin precursor by heating.

16. The method of producing the droplet ejection head according to claim 11, wherein the nozzle plate comprises a polyimide resin.

17. The method of producing the droplet ejection head according to claim 11, wherein forming the nozzle on the nozzle plate includes irradiating with a laser the opposite surface of the nozzle plate to the surface on which the water-repellent film is formed.

18. The method of producing the droplet ejection head according to claim 17, wherein the laser is an excimer laser.

19. The method of producing the droplet ejection head according to claim 11, wherein the tetrahedral amorphous carbon film has a thickness of about 20 to 40 nm.

* * * * *